US007802318B2

(12) United States Patent
Chen

(10) Patent No.: US 7,802,318 B2
(45) Date of Patent: Sep. 28, 2010

(54) HELMET HAVING COOLING FAN DEVICE

(76) Inventor: Chun-Nan Chen, 182, Haichung St., An Nan District, Tainan (TW)

( * ) Notice: Subject to any disclaimer, the term of this patent is extended or adjusted under 35 U.S.C. 154(b) by 1009 days.

(21) Appl. No.: 11/585,374

(22) Filed: Oct. 24, 2006

(65) Prior Publication Data

US 2008/0141442 A1 Jun. 19, 2008

(51) Int. Cl.
*A42C 5/04* (2006.01)

(52) U.S. Cl. ..... 2/171.3; 2/7; 2/410

(58) Field of Classification Search ..... 2/2.14, 2/171.3, 410, 411, 422, 424; 62/529.3, 539.2
See application file for complete search history.

(56) References Cited

U.S. PATENT DOCUMENTS 735,790 A * 8/1903 Meeza ..... 2/171.3
1,825,114 A * 9/1931 Hendrickson ..... 416/237
2,335,630 A * 11/1943 Bachardy ..... 2/7
3,000,190 A * 9/1961 Stark ..... 62/259.3
3,168,748 A * 2/1965 Limberg ..... 2/171.3
3,353,191 A * 11/1967 Dahly ..... 2/171.3
3,391,407 A * 7/1968 Waters ..... 2/171.3
3,813,696 A * 6/1974 Yeager ..... 2/171.3
3,822,698 A * 7/1974 Guy ..... 128/201.25
3,881,198 A * 5/1975 Waters ..... 2/171.3
4,238,857 A * 12/1980 Waters ..... 2/171.3
4,483,021 A * 11/1984 McCall ..... 2/7
4,618,099 A * 10/1986 Nagao et al. ..... 239/332
4,680,815 A * 7/1987 Hirsch et al. ..... 2/171.3
4,744,106 A * 5/1988 Wang ..... 2/7
4,893,356 A * 1/1990 Waters ..... 2/171.3
RE33,286 E * 8/1990 Waters ..... 2/171.3
5,085,231 A * 2/1992 Johnson ..... 131/329
5,104,430 A * 4/1992 Her-Mou ..... 55/385.1
5,123,114 A * 6/1992 Desanti ..... 2/8.6
5,425,620 A * 6/1995 Stroud ..... 416/63
5,533,206 A * 7/1996 Petrie et al. ..... 2/8.5
5,533,500 A * 7/1996 Her-Mou ..... 128/201.25
5,561,862 A * 10/1996 Flores, Sr. ..... 2/171.3
5,711,033 A * 1/1998 Green et al. ..... 2/171.3
5,834,935 A * 11/1998 Lyford ..... 324/156
6,081,929 A * 7/2000 Rothrock et al. ..... 2/171.3
6,122,773 A * 9/2000 Katz ..... 2/171.3
6,481,019 B2 * 11/2002 Diaz et al. ..... 2/171.3
6,547,741 B2 * 4/2003 Mori et al. ..... 600/490
6,760,925 B1 * 7/2004 Maxwell ..... 2/171.3
6,973,677 B2 * 12/2005 Diaz et al. ..... 2/171.3
7,114,194 B2 * 10/2006 English ..... 2/171.3
7,127,907 B2 * 10/2006 Tu ..... 62/259.3
7,143,451 B2 * 12/2006 Lundgren ..... 2/171.3
7,200,873 B2 * 4/2007 Klotz et al. ..... 2/171.3

(Continued)

*Primary Examiner*—Katherine Moran
*Assistant Examiner*—Richale L Quinn
(74) *Attorney, Agent, or Firm*—Alan Kamrath; Kamrath & Associates PA

(57) ABSTRACT

A helmet includes a helmet body, and a cooling fan device mounted in the helmet body to introduce an ambient air into the helmet body. The cooling fan device includes a support base, a cooling fan, a battery, and a control switch. Thus, the cooling fan is operated to introduce the ambient air through the vent hole of the helmet body into the helmet body to provide ventilating and radiating effects to a user wearing the helmet body so as to provide a comfortable sensation to the user.

15 Claims, 3 Drawing Sheets

U.S. PATENT DOCUMENTS

| | | | | |
|---|---|---|---|---|
| 7,477,330 | B2 * | 1/2009 | Magnusson et al. | 349/14 |
| 2001/0032348 | A1 * | 10/2001 | Diaz et al. | 2/171.3 |
| 2004/0084071 | A1 * | 5/2004 | Gray | 135/16 |
| 2006/0172183 | A1 * | 8/2006 | Chen et al. | 429/97 |
| 2007/0028372 | A1 * | 2/2007 | VanDerWoude et al. | 2/457 |
| 2007/0113318 | A1 * | 5/2007 | Weston | 2/171.3 |
| 2007/0151002 | A1 * | 7/2007 | Klotz et al. | 2/410 |
| 2007/0277294 | A1 * | 12/2007 | Green | 2/410 |
| 2008/0141442 | A1 * | 6/2008 | Chen | 2/411 |
| 2008/0280200 | A1 * | 11/2008 | Takahashi et al. | 429/179 |
| 2009/0291357 | A1 * | 11/2009 | Hua | 429/100 |

* cited by examiner

HELMET HAVING COOLING FAN DEVICE

BACKGROUND OF THE INVENTION

1. Field of the Invention

The present invention relates to a helmet and, more particularly, to a helmet having a cooling fan device to provide ventilating and heat radiating effects.

2. Description of the Related Art

A conventional helmet in accordance with the prior art shown in FIG. 6 comprises a helmet body 1 having a periphery formed with a plurality of vent holes 10 to provide a ventilating effect to a user wearing the helmet body 1. However, the vent holes 10 only provide a little ventilating effect to the user, thereby easily causing an uncomfortable sensation to the user, especially in the summer or at a hotter working place. In addition, the vent holes 10 cannot provide a heat radiating effect.

BRIEF SUMMARY OF THE INVENTION

In accordance with the present invention, there is provided a helmet, comprising a helmet body, and a cooling fan device mounted in the helmet body to introduce an ambient air into the helmet body.

The primary objective of the present invention is to provide a helmet having a cooling fan device to provide ventilating and heat radiating effects.

Another objective of the present invention is to provide a helmet, wherein the cooling fan is operated to introduce the ambient air from the fan holder through the vent hole of the helmet body into the helmet body to provide ventilating and radiating effects to a user wearing the helmet body so as to provide a comfortable sensation to the user.

A further objective of the present invention is to provide a helmet, wherein the support base is mounted on and detached from the helmet body by pushing the support base relative to the helmet body, so that the cooling fan device is mounted on and detached from the helmet body easily and quickly, thereby facilitating the user assembling and disassembling the cooling fan device.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
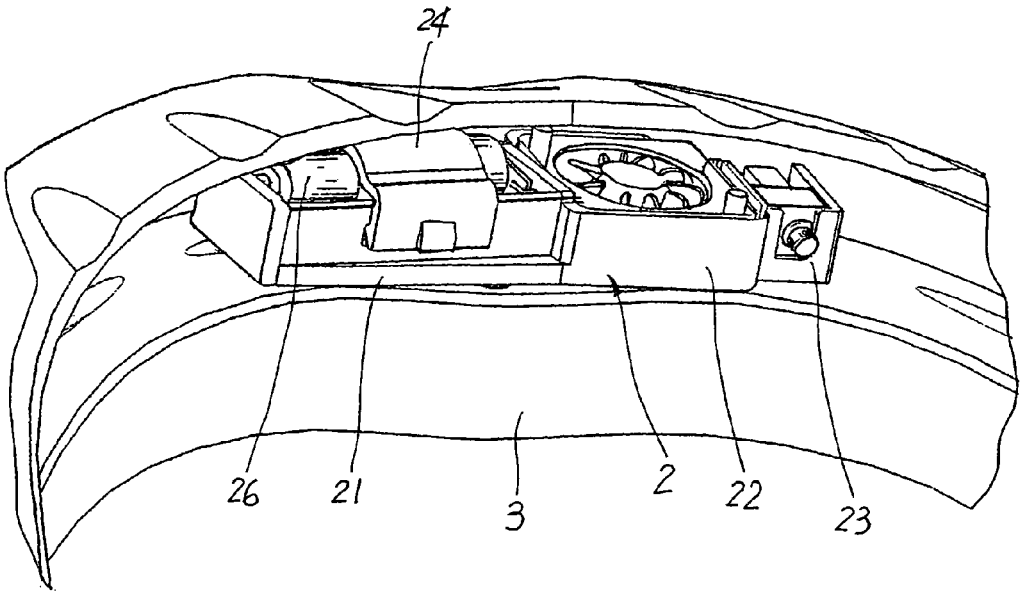
FIG. 1 is a partially perspective cut-away view of a helmet in accordance with the preferred embodiment of the present invention.
Figure 2:
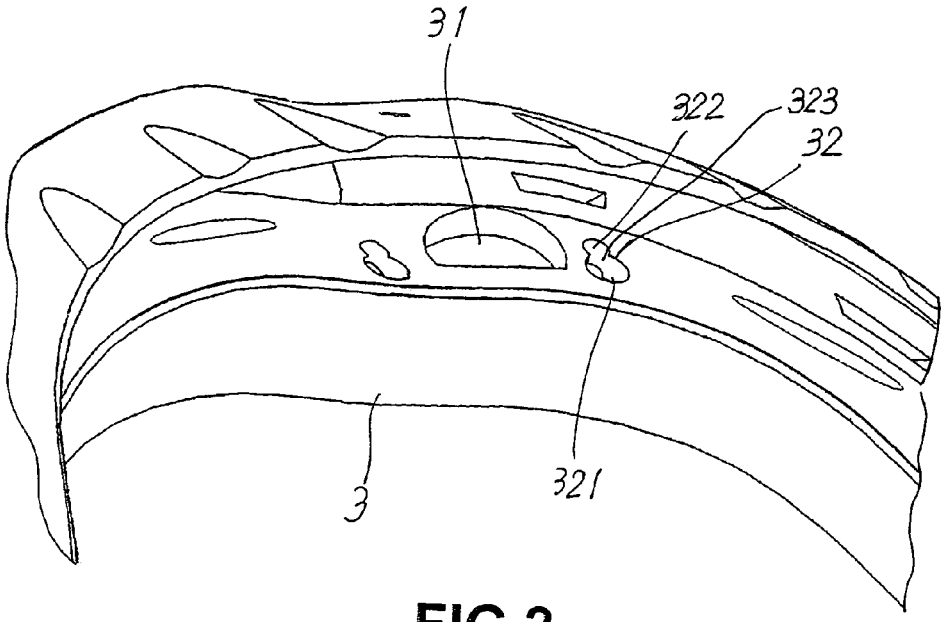
FIG. 2 is a perspective view of a helmet body of the helmet as shown in FIG. 1.
Figure 3:
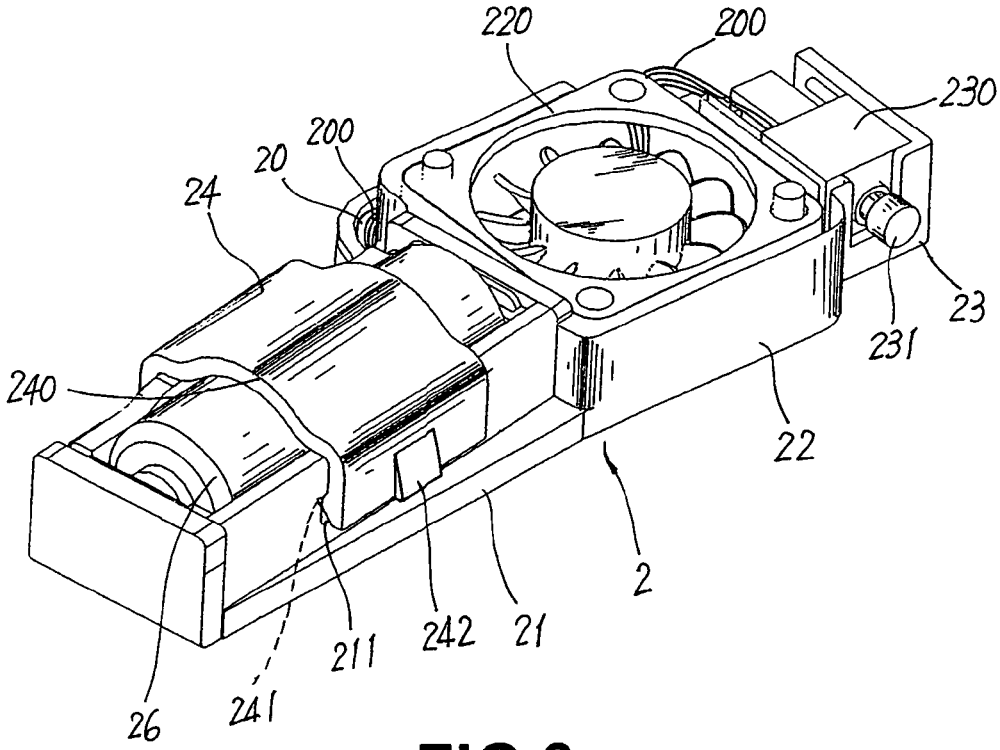
FIG. 3 is a perspective view of a cooling fan device of the helmet as shown in FIG. 1.
Figure 4:
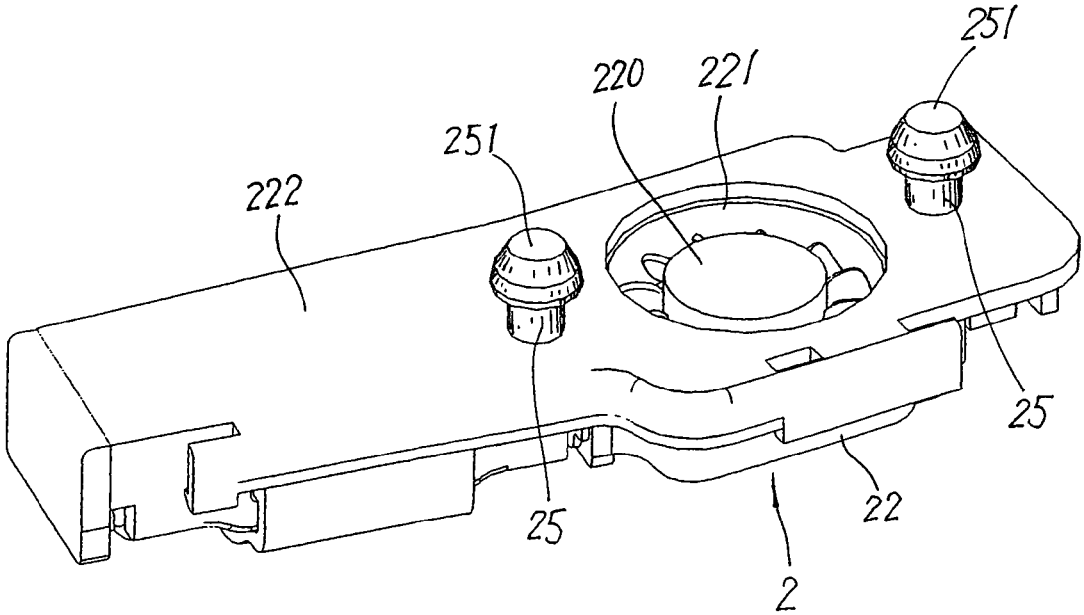
FIG. 4 is a bottom perspective view of the cooling fan device of the helmet as shown in FIG. 3.
Figure 5:
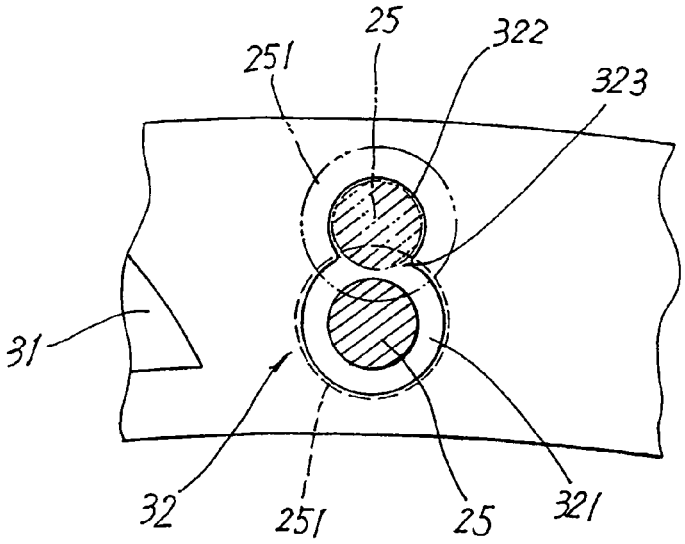
FIG. 5 is a partially plan cross-sectional view of the helmet as shown in FIG. 1.
Figure 6:
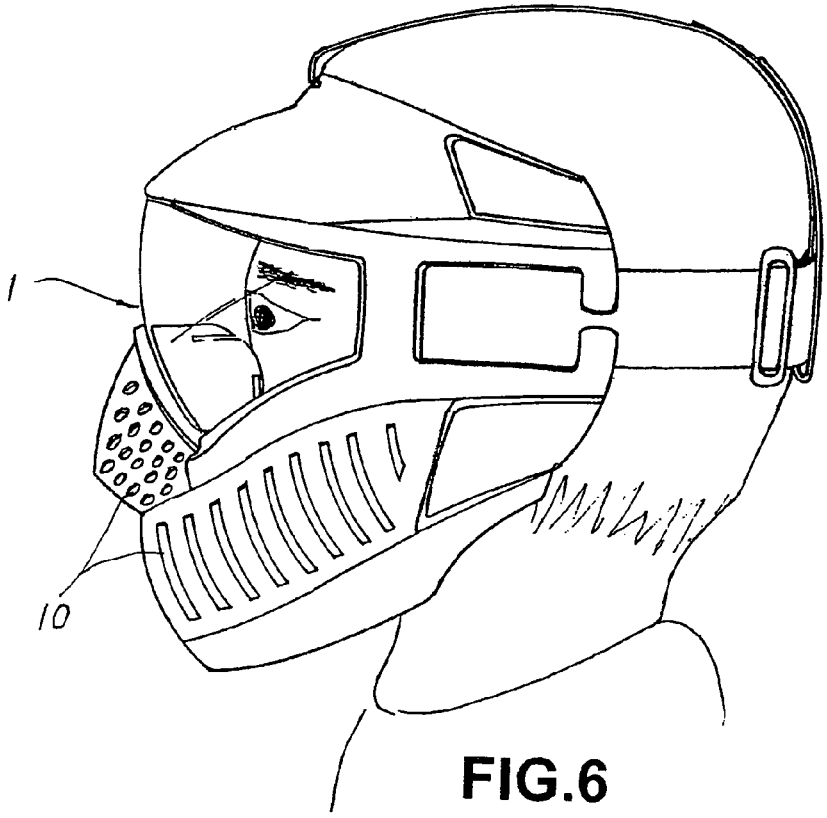
FIG.6 PRIOR ART
FIG. 6 is a plan view of a conventional helmet in accordance with the prior art.

Referring to the drawings and initially to FIG. 1, a helmet in accordance with the preferred embodiment of the present invention comprises a helmet body 3, and a cooling fan device mounted in the helmet body 3 to introduce an ambient air into the helmet body 3.

Referring to FIGS. 1-5, the helmet body 3 has an upper end formed with a vent hole 31 and two locking slots 32. The vent hole 31 of the helmet body 3 is located between the locking slots 32. Each of the locking slots 32 of the helmet body 3 has a substantially calabash shape and has a first end formed with an entrance hole 321, a second end formed with a locking hole 322 having a diameter smaller than that of the entrance hole 321, and a mediate portion formed with a guide hole 323 located between the entrance hole 321 and the locking hole 322 and formed on a connection of the entrance hole 321 and the locking hole 322.

The cooling fan device includes a support base 2 removably mounted on the helmet body 3, a cooling fan 220 mounted on the support base 2, a battery 26 mounted on the support base 2 and connected to the cooling fan 220 to provide an electric power to the cooling fan 220, and a control switch 230 mounted on the support base 2 and connected to the cooling fan 220 and the battery 26 to control operation of the cooling fan 220.

The support base 2 is provided with a fan holder 22 to receive the cooling fan 220, a battery holder 21 to receive the battery 26, and a switch holder 23 to receive the control switch 230. The control switch 230 is provided with a press button 231 to turn on/off the cooling fan 220. The support base 2 has a periphery formed with a receiving groove 20 to receive and store a plurality of conducting cords 200 which are connected to the battery 26, the cooling fan 220 and the control switch 230.

The cooling fan device further includes a flexible battery cover 24 removably mounted on the battery holder 21 and rested on the battery 26 to retain the battery 26 in the battery holder 21 to prevent the battery 26 from being detached from the battery holder 21. The battery holder 21 has two opposite sides each formed with a locking groove 211, and the battery cover 24 is substantially inverted U-shaped and has two opposite sides each having an inner portion formed with an inwardly extending locking hook 241 detachably snapped into the respective locking groove 211 of the battery holder 21 and an outer portion formed with an outwardly extending wedge-shaped grip portion 242 to facilitate a user holding and removing the battery cover 24 from the battery holder 21. The battery cover 24 has a top portion formed with a substantially arc-shaped resting plate 240 rested on the battery 26.

The support base 2 has a planar bottom plate 222 formed with an opening 221 connected to the fan holder 22 and the vent hole 31 of the helmet body 3 to align the cooling fan 220 with the vent hole 31 of the helmet body 3 to introduce the ambient air from the fan holder 22 through the vent hole 31 of the helmet body 3 into the helmet body 3 by rotation of the cooling fan 220. The bottom plate 222 of the support base 2 is also formed with two outwardly extending locking tenons 25 each inserted into and movable in the respective locking slot 32 of the helmet body 3 and each having a distal end formed with an enlarged locking head 251 passed through the entrance hole 321 and the guide hole 323 of the respective locking slot 32 and detachably locked in the locking hole 322 of the respective locking slot 32. The locking head 251 of each of the locking tenons 25 has a diameter greater than that of the locking hole 322 of the respective locking slot 32 and smaller than that of the entrance hole 321 of the respective locking slot 32 and has a conical shape to facilitate insertion of the locking head 251 of each of the locking tenons 25 into the entrance hole 321 of the respective locking slot 32. The opening 221 of the support base 2 is located between the locking tenons 25.

In operation, referring to FIGS. 1-5, the press button 231 of the control switch 230 is pressed to turn on the cooling fan 220 which is started and rotated to introduce the ambient air from the fan holder 22 through the vent hole 31 of the helmet body 3 into the helmet body 3 to provide ventilating and radiating effects to a user wearing the helmet body 3 so as to provide a comfortable sensation to the user.

When not in use, the support base 2 is pushed relative to the helmet body 3 so that each of the locking tenons 25 of the support base 2 is movable from the locking hole 322 of the respective locking slot 32 to the entrance hole 321 of the respective locking slot 32, while the locking head 251 of each of the locking tenons 25 is unlocked from the locking hole 322 of the respective locking slot 32 and removed from the entrance hole 321 of the respective locking slot 32, thereby detaching each of the locking tenons 25 of the support base 2 from the respective locking slot 32 the helmet body 3, and thereby removing the support base 2 from the helmet body 3.

When the user wishes to replace the battery 26, the user applies an upward and outward force on the grip portions 242 of the battery cover 24, so that each of the locking hooks 241 of the battery cover 24 are moved outwardly to detach from the respective locking groove 211 of the battery holder 21 by flexibility of the battery cover 24, thereby removing the battery cover 24 from the battery holder 21, and thereby removing the battery 26 from the battery holder 21 for replacement of the battery 26.

Accordingly, the cooling fan 220 is operated to introduce the ambient air from the fan holder 22 through the vent hole 31 of the helmet body 3 into the helmet body 3 to provide ventilating and radiating effects to a user wearing the helmet body 3 so as to provide a comfortable sensation to the user. In addition, the support base 2 is mounted on and detached from the helmet body 3 by pushing the support base 2 relative to the helmet body 3, so that the cooling fan device is mounted on and detached from the helmet body 3 easily and quickly, thereby facilitating the user assembling and disassembling the cooling fan device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A helmet, comprising:

a helmet body;

a cooling fan device mounted in the helmet body to introduce an ambient air into the helmet body;

wherein the cooling fan device includes:

a support base removably mounted on the helmet body;

a cooling fan mounted on the support base;

a battery mounted on the support base and connected to the cooling fan to provide an electric power to the cooling fan; and a control switch mounted on the support base and connected to the cooling fan and the battery to control operation of the cooling fan;

wherein the helmet body has an upper end formed with a vent hole, and the support base has a planar bottom plate formed with an opening connected to the fan holder and the vent hole of the helmet body to align the cooling fan with the vent hole of the helmet body to introduce the ambient air from the fan holder through the vent hole of the helmet body into the helmet body by rotation of the cooling fan;

wherein the upper end of the helmet body is formed with two locking slots each having a first end formed with an entrance hole, a second end formed with a locking hole having a diameter smaller than that of the entrance hole, and a mediate portion formed with a guide hole located between the entrance hole and the locking hole and formed on a connection of the entrance hole and the locking hole, and the bottom plate of the support base is formed with two outwardly extending locking tenons each inserted into and movable in the respective locking slot of the helmet body and each having a distal end formed with an enlarged locking head passed through the entrance hole and the guide hole of the respective locking slot and detachably locked in the locking hole of the respective locking slot.

2. The helmet in accordance with claim 1, wherein the support base is provided with a fan holder to receive the cooling fan.

3. The helmet in accordance with claim 1, wherein the support base is provided with a battery holder to receive the battery.

4. The helmet in accordance with claim 3, wherein the cooling fan device further includes a flexible battery cover removably mounted on the battery holder and rested on the battery to retain the battery in the battery holder to prevent the battery from being detached from the battery holder.

5. The helmet in accordance with claim 4, wherein the battery holder has two opposite sides each formed with a locking groove, and the battery cover has two opposite sides each having an inner portion formed with an inwardly extending locking hook detachably snapped into the respective locking groove of the battery holder and an outer portion formed with an outwardly extending grip portion to facilitate a user holding and removing the battery cover from the battery holder.

6. The helmet in accordance with claim 4, wherein the battery cover is substantially inverted U-shaped.

7. The helmet in accordance with claim 4, wherein the grip portion of the battery cover is substantially wedge-shaped.

8. The helmet in accordance with claim 4, wherein the battery cover has a top portion formed with a substantially arc-shaped resting plate rested on the battery.

9. The helmet in accordance with claim 1, wherein the support base is provided with a switch holder to receive the control switch.

10. The helmet in accordance with claim 1, wherein the control switch is provided with a press button to turn on/off the cooling fan.

11. The helmet in accordance with claim 1, wherein the support base has a periphery formed with a receiving groove to receive and store a plurality of conducting cords which are connected to the battery, the cooling fan and the control switch.

12. The helmet in accordance with claim 1, wherein each of the locking slots of the helmet body has a substantially calabash shape.

13. The helmet in accordance with claim 1, wherein the vent hole of the helmet body is located between the locking slots, and the opening of the support base is located between the locking tenons.

14. The helmet in accordance with claim 1, wherein the locking head of each of the locking tenons has a diameter greater than that of the locking hole of the respective locking slot and smaller than that of the entrance hole of the respective locking slot.

15. The helmet in accordance with claim 1, wherein the locking head of each of the locking tenons has a conical shape to facilitate insertion of the locking head of each of the locking tenons into the entrance hole of the respective locking slot.

* * * * *